US005379475A

United States Patent [19]

Sivacoe

[11] Patent Number: 5,379,475

[45] Date of Patent: Jan. 10, 1995

[54] SCRAPER FOR A PIPE PIG

[76] Inventor: Orlande Sivacoe, #601, 4700 - 55 St., Red Deer, Alberta, Canada T4N 2H8

[21] Appl. No.: 102,265

[22] Filed: Aug. 5, 1993

[51] Int. Cl.[6] ..... B08B 9/02

[52] U.S. Cl. ..... 15/104.061

[58] Field of Search ..... 15/104.061, 104.062, 15/104.063, 3.5, 3.51, 3.52

[56] References Cited

U.S. PATENT DOCUMENTS

| | | | |
|---|---|---|---|
| 1,547,440 | 7/1925 | Penn | 15/104.061 |
| 1,683,429 | 9/1928 | Walker | 15/104.061 |
| 1,835,238 | 12/1931 | Oberhuber | 15/104.061 |
| 2,170,997 | 8/1939 | Griffin | 15/104.061 |
| 2,317,542 | 4/1943 | Lincoln | 15/104.061 |
| 3,939,519 | 2/1976 | Muirhead . | |
| 4,077,079 | 3/1978 | Knapp . | |
| 4,081,875 | 4/1978 | Nishino . | |
| 4,244,073 | 1/1981 | Sagawa . | |
| 4,406,031 | 9/1983 | Eimer et al. . | |
| 4,876,761 | 10/1989 | Sagawa . | |

FOREIGN PATENT DOCUMENTS

| | | | |
|---|---|---|---|
| 57790/90 | 6/1990 | Australia . | |
| 893801 | 4/1962 | United Kingdom | 15/104.061 |
| 2229247A | 9/1990 | United Kingdom . | |

*Primary Examiner*—Edward L. Roberts
*Attorney, Agent, or Firm*—Anthony R. Lambert

[57] ABSTRACT

A scraper for a pipeline pig. The scraper is made from a single metal blank, having a plurality of fins disposed radially about a common central axial member. Each fin includes a scraping end and a connector end. The connector end is connected to the common central axial member, and the scraping end extends circumferentially outward from the connector end. Each scraping end preferably forms a quarter circle, and the fins are connected in plural pairs to the common central axial member with adjacent pairs rotationally offset in relation to each other about the common central axial member, preferably about 45° apart. In use, the scraper is embedded in an elastic pig body.

7 Claims, 2 Drawing Sheets

SCRAPER FOR A PIPE PIG

FIELD OF THE INVENTION

This invention relates to scrapers for pipe pigs.

BACKGROUND AND SUMMARY OF THE INVENTION

In U.S. Pat. No. 5,150,493, issued Sep. 29, 1992, there is disclosed a pipe pig having removable appendages or pins disposed circumferentially around and extending radially outward from the elastomeric body of the pipe pig. While these appendages have proven useful for pipe pigs having a dimension in the order of 10 cm or larger, for pipes having a dimension in the order of 1–2 cm, the pins become awkward to handle and retaining them in the pig becomes difficult.

Pipelines are usually cylindrical and have a central axis. Pipe pigs likewise are usually cylindrical and have a central axis that during use will more or less coincide with the central axis of the pipeline. Scraper elements on a pipeline pig are used to scrape scale off the inside of the pipe and for this reason are usually disposed about the pipeline pig so that they scrape the full inner circumference of the pipe. Examples of prior art scrapers include bristles with bases affixed to a sponge rubber element (U.S. Pat. No. 4,406,031), a spiral blade wound around and extending from a hollow shaft ((U.S. Pat. No. 4,081,875), U-shaped staples embedded in a foamed plastic body (U.S. Pat. No. 4,077,079), several discs extending radially from and concentric to an elongated core (U.S. Pat. No. 3,939,519), pins with anchors extending radially from an elastic cylinder (U.S. Pat. Nos. 4,244,073 and 4,876,761), flexible polyurethane discs of solid construction centrally apertured for mounting on a pipeline pig, the discs having cleaning fingers extending radially from their outer peripheries (United Kingdom patent application no. 2,229,247) and annular sealing lips embedded in shallow annular grooves of an integral elastomeric body (Australian application AU-A-57790/90). These devices tend to be unsuitable for use with small pipes, as for example found in heat exchangers. In particular, the scrapers tend to be complex and expensive.

The inventor has proposed a novel scraper for a pipeline pig. In one embodiment of the invention, the scraper is made from a single metal blank, having a plurality of fins disposed radially about a common central axial member. Each fin includes a scraping end and a connector end. The connector end is connected to the common central axial member, preferably with a portion that is separated from the common central axial member and the scraping end extends circumferentially outward from the connector end. In this manner, the scraping end is cantilevered on the connector end.

Each scraping end preferably forms a quarter circle, and the fins are connected in plural pairs to the common central axial member with adjacent pairs rotationally offset in relation to each other about the common central axial member, preferably about 45° apart so that the scraping ends together cover the circumference of the pipe. In use, the scraper is embedded in an elastic pig body which is placed into and forced through the pipe under hydraulic pressure in known manner.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
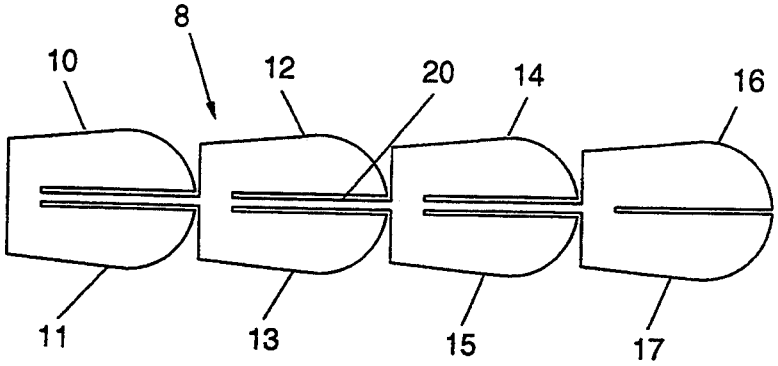
FIG. 1 is a plan view of a scraper blank according to the invention.
Figure 2:
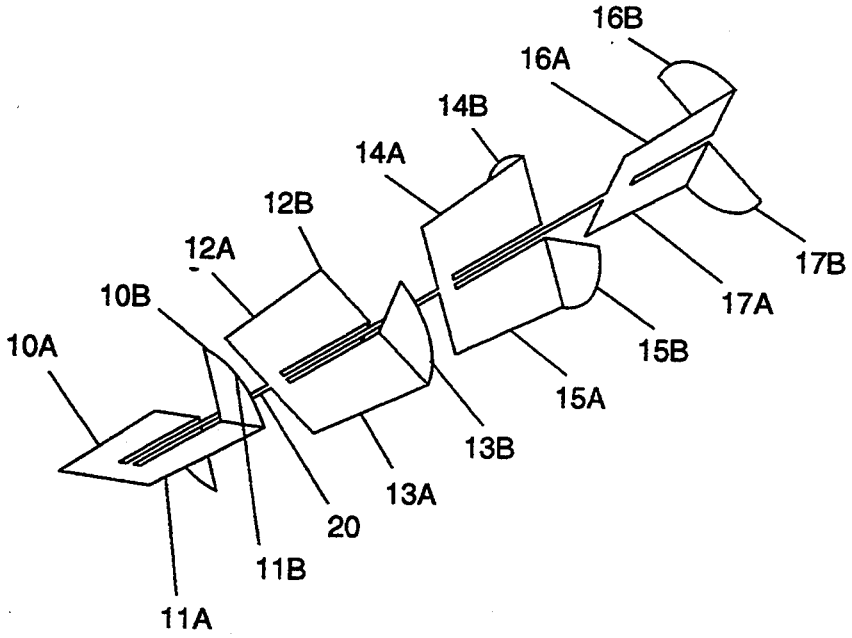
FIG. 2 is a perspective of a scraper according to the invention prepared for embedding in a pipe pig body.
Figure 3:
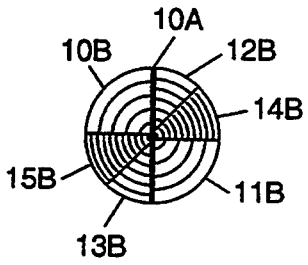
FIG. 3 is an end view of the scraper of FIG. 2.
Figure 4:
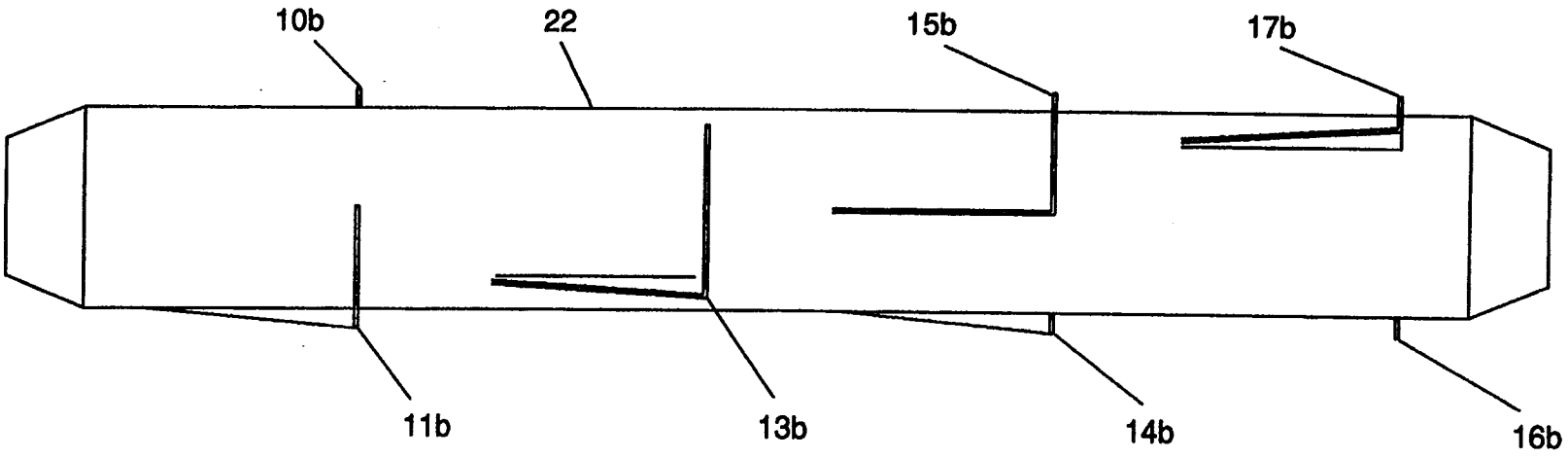
FIG. 4 is a side view of a scraper according to the invention embedded in a pipe pig body.

Referring to FIGS. 1 and 2, there is shown a single thin blank 8 preferably made of metal cut into a shape suitable for use as a scraper for a pipe pig. The blank 8 has a plurality of fins 10, 11, 12, 13, 14, 15, 16 and 17 disposed radially about a common central axial member 20. Each fin 10, 11, 12, 13, 14, 15, 16 and 17 includes a scraping end B and a connector end A. Each connector end A is connected to and, as shown, at least partially coplanar to the common central axial member 20. Each scraping end B extends out of the plane of and circumferentially from its connector end A. As shown, the scraping ends B extend perpendicularly from the connector ends A along a line that is perpendicular to the common central axial member. The scraping ends B preferably lie in planes whose normals lie more or less parallel to the common central axial member 20. As best seen in FIGS. 2, 3 and 4, the scraping ends B collectively covering substantially a full circle when viewed along the common central axial member 20.

The fins 10, 11, 12, 13, 14, 15, 16 and 17 are each disconnected from the common central axial member 20 in a common direction from each connector end A (left to right in FIG. 2), such that the fins form cantilever springs, with the scraping ends cantilevered. Preferably, the outer peripheral edge of each scraping end B forms an arc of a circle, and as shown, each scraping end B forms a quarter circle. The fins 10, 11, 12, 13, 14, 15, 16 and 17 are connected in plural pairs (10, 11), (12, 13), (14, 15) and (16, 17) to the common central axial member 20 and adjacent pairs are rotationally offset in relation to each other about the common central axial member 20. Scraping ends B of any pair of fins are preferably bent away from each other.

As shown in FIGS. 2, 3 and 4, each pair of fins is rotationally offset about 45° from each adjacent pair of fins. Exact rotational alignment of the pairs of fins is not required. The object of offsetting the fins is to obtain full coverage of the interior of a pipe to be scraped. Some duplication of overlap between the fins is preferred to ensure a significant cleaning effect, and as shown the scraper will on average scrape each portion of a pipe interior twice with one pass of the pig. With four pairs of fins, therefore eight fins and eight scraping ends B, if two pairs of fins are offset by more than 45°, some others will be offset less than 45°.

In use, the scraper is embedded in an elastic pig body 22 as shown in FIG. 4. The scraping ends B protrude out from the body 22. When the pig is first formed, the outer surface material forming the elastic pig body 22 should be flush with the outer circumferential edges of the scraping ends B. As the pig body 22 wears during use, the scraping ends B will protrude from the body 22.

The manner of forming the single blank 8 is as follows. A single blank of 1019 flat steel or such other steel, metal or other material as is suitable for the application and having a thickness about 0.015" to 0.200" thick (depending on the material) is first cut to the shape shown in FIG. 1. If flat steel is used, the blank 8 is then heat treated with dye to form it into spring steel. The scraping ends B are bent in relation to the connecting ends A, and the fins hand twisted to make the fins rotationally offset. The blank 8 is then placed in a mold and appropriate resins used to make the elastic pig body 22. Due to reduction in size of the pig body during curing of the resins, the blank 8 will be covered by the resins when the resins are initially poured or injected into the mold.

With the fins made of spring steel or other resilient, hard material, and the connector ends forming cantilevers, the scraping ends may fit snugly in a pipe to be cleaned, with gentle pressure on the scraping ends. Such an arrangement allows the scraper to gently scrape contaminants from the inside of the pipe without unduly gouging the inside of the pipe itself. In addition, the resilience of the fins allows the pig to pass small obstructions, as created for example by welds extending into the pipe. The scraper and the pig as described are also flexible and may therefore pass tight bends in the pipe.

Various sizes of scraper are contemplated, although the scraper is believed to have greatest utility for pigs of ½" to 4" in diameter, particularly ¾" diameter. The blank 8 shown is about ¾" in diameter and ½" long.

A person skilled in the art could make immaterial modifications to the invention described and claimed in this patent without departing from the essence of the invention.

The embodiments of the invention in which an exclusive property or privilege is claimed are defined as follows:

1. A scraper for a pipe pig, the scraper comprising:

a unitary blank having a plurality of fins disposed radially about a common central axial member;

each fin including a scraping end and a connector end, the connector end being connected to the common central axial member, and the scraping end extending circumferentially from the connector end; and the scraping ends having peripheral edges and the peripheral edges collectively covering substantially a full circle when viewed along the common central axial member.

2. The scraper of claim 1 in which the fins are each cantilevered in a common direction along the common central axial member.

3. The scraper of claim 2 in which each scraping end forms a quarter circle.

4. The scraper of claim 1 in which the fins are connected in plural pairs to the common central axial member,and adjacent pairs are rotationally offset in relation to each other about the common central axial member.

5. The scraper of claim 4 in which each scraping end forms a quarter circle.

6. A pipe pig comprising:

an elastic body; and a scraper embedded in the elastic body, the scraper being formed from a single blank having a plurality of fins integrally connected to and disposed radially about a common central axial member.

7. The pipe pig of claim 6 in which:

each fin includes a scraping end and a connector end, the connector end being connected to the common central axial member, and the scraping end extending circumferentially from the connector end; and the scraping ends having peripheral edges and the peripheral edges collectively covering substantially a full circle when viewed along the common central axial member.

* * * * *